US008912461B2

(12) United States Patent
Rane et al.

(10) Patent No.: US 8,912,461 B2
(45) Date of Patent: Dec. 16, 2014

(54) ARC CHUTE ASSEMBLY AND METHOD OF MANUFACTURING SAME

(75) Inventors: Mahesh Jaywant Rane, Secunderabad (IN); Jayesh Mavji Maru, Hyderabad (IN); Simhadri Ramalingeswara Rao Gupta, Secunderabad (IN)

(73) Assignee: General Electric Company, Schenectady, NY (US)

( * ) Notice: Subject to any disclaimer, the term of this patent is extended or adjusted under 35 U.S.C. 154(b) by 417 days.

(21) Appl. No.: 13/356,076

(22) Filed: Jan. 23, 2012

(65) Prior Publication Data

US 2013/0186863 A1 Jul. 25, 2013

(51) Int. Cl.
*H01H 9/36* (2006.01)

(52) U.S. Cl.
USPC ..... 218/151; 218/34; 218/149

(58) Field of Classification Search
CPC ..... H01H 9/30; H01H 9/32; H01H 9/34; H01H 9/342; H01H 9/36; H01H 9/40
USPC ..... 218/15, 34, 35–41, 149–151; 335/201
See application file for complete search history.

(56) References Cited

U.S. PATENT DOCUMENTS

| | | | | |
|---|---|---|---|---|
| 2,293,487 | A | 8/1942 | Bartlett | |
| 2,310,728 | A | 2/1943 | Bartlett | |
| 2,393,164 | A | 1/1946 | Hobson | |
| 2,417,638 | A | 3/1947 | Egowin | |
| 3,296,402 | A | 1/1967 | Meinders | |
| 3,790,911 | A * | 2/1974 | Kick et al. | 335/201 |
| 4,656,446 | A * | 4/1987 | Chien et al. | 335/201 |
| 4,958,135 | A | 9/1990 | Baginski et al. | |
| 5,449,871 | A * | 9/1995 | Batteux et al. | 200/401 |
| 5,499,186 | A | 3/1996 | Carosa | |
| 5,504,292 | A | 4/1996 | Bennett et al. | |
| 6,034,586 | A | 3/2000 | Runyan et al. | |
| 6,248,971 | B1 | 6/2001 | Morel et al. | |
| 6,337,613 | B1 | 1/2002 | Grelier et al. | |
| 6,420,948 | B1 | 7/2002 | Runyan | |
| 6,700,087 | B2 | 3/2004 | Rademacher et al. | |
| 7,094,986 | B2 | 8/2006 | Shea | |
| 7,116,194 | B2 | 10/2006 | Azzola et al. | |

(Continued)

FOREIGN PATENT DOCUMENTS

| | | |
|---|---|---|
| DE | 19734676 A1 | 2/1999 |
| EP | 0053973 A1 | 6/1982 |

(Continued)

OTHER PUBLICATIONS

Search Report and Written Opinion for EP Application No. 13152343.3 dated May 8, 2013.

*Primary Examiner* — Amy Cohen Johnson
*Assistant Examiner* — Marina Fishman
(74) *Attorney, Agent, or Firm* — General Electric Company

(57) ABSTRACT

An arc chute assembly includes a housing having a first wall, a second wall, and a pair of side walls coupled to the first wall. The walls configured to form an arc area. The housing further having a divider wall coupled to the first wall between the side walls. The divider wall configured to form a first sub-arc area, a second sub-arc area, and an arc plate area. The first sub-arc area and the second sub-arc area are configured to be in flow communication with the arc plate area. The arc chute assembly further comprises a support coupled to the first wall and the side walls, and an arc plate coupled to the support. The arc plate having a body extending between the side walls and over the divider wall.

20 Claims, 8 Drawing Sheets

(56) References Cited

U.S. PATENT DOCUMENTS

| | | | | |
|---|---|---|---|---|
| 7,186,941 | B2 * | 3/2007 | Yeon | 218/38 |
| 7,488,915 | B2 | 2/2009 | Pollitt et al. | |

FOREIGN PATENT DOCUMENTS

| | | | | |
|---|---|---|---|---|
| EP | 0432865 | A2 | 6/1991 | |
| EP | 0195862 | B2 | 12/1993 | |
| EP | 0322321 | B1 | 2/1994 | |
| EP | 0619591 | * | 3/1994 | H01H 71/74 |
| EP | 0619592 | A1 | 10/1994 | |
| EP | 1107269 | A1 | 6/2001 | |
| EP | 1107269 | B1 | 8/2006 | |
| EP | 2110838 | A2 | 10/2009 | |
| WO | 0011695 | A1 | 3/2000 | |
| WO | 0024012 | A1 | 4/2000 | |

* cited by examiner

ARC CHUTE ASSEMBLY AND METHOD OF MANUFACTURING SAME

BACKGROUND OF THE INVENTION

The embodiments described herein relate generally to an arc chute assembly for a circuit breaker, and more particularly, to methods and systems used to distribute gas pressure formed within a circuit breaker.

The capability of circuit breakers for current-interruption can be dependent, in part, upon the ability to extinguish the arc that is generated when the breaker contacts open. Even though the contacts separate, current can continue to flow through the ionized gases formed by vaporization of the contacts and surrounding materials. Circuit breakers require expedient and efficient cooling of the arc to facilitate effective current interruption. Circuit breakers include sub-poles that are located in arc chutes. The arc chutes are configured to extinguish the arc that is produced when the breaker is tripped and the contacts of the breaker are rapidly opened. Typically, each arc chute is associated with a single phase, for example, one phase of a 3-phase power distribution system.

Conventional arc chutes include a series of metallic plates that are configured in a spaced apart relationship and held in place by dielectric side panels. When the contacts of the breaker are opened, the resulting arc is driven to the metallic plates of the arc chute where the arc is then extinguished by the plates. The metallic plates increase the arc voltage in the circuit breaker to produce a current-limiting effect thereby providing downstream protection.

Each sub-pole for the current path of the circuit breaker includes an arc chute. The sub-poles are electrically connected in parallel and separated inside the circuit breaker by a divider wall. Due to component variations, one sub-pole may experience a higher pressure than the other sub-pole when the breaker is tripped. While increasing the volume of gas generated during current-interruption and enhancing current flow aids in extinguishing the arc, the increased volume of gas increases pressure within the sub-poles, and therefore, on the arc chute and the circuit breaker housing. In some cases, the sub-pole that is exposed to the higher pressure may experience damage to the housing walls and the arc chute which may limit the current-interruption capability of the circuit breaker.

BRIEF DESCRIPTION OF THE INVENTION

In one aspect, an arc chute assembly is provided. The arc chute assembly comprises a housing having a first wall, a second wall, and a pair of side walls coupled to the first wall. The walls configured to form an arc area. The housing further having a divider wall coupled to the first wall between the side walls. The divider wall configured to form a first sub-arc area, a second sub-arc area, and an arc plate area. The first sub-arc area and the second sub-arc area are configured to be in flow communication with the arc plate area. The arc chute assembly further comprises a support coupled to the first wall and the side walls, and an arc plate coupled to the support. The arc plate having a body extending between the side walls and over the divider wall.

In another aspect, a power distribution system is provided. The power distribution system comprises a housing having a first wall, a second wall and a pair of side walls coupled to the first wall. The first wall and the side walls are configured to form an arc area. The housing further having a divider wall coupled to the first wall between the side walls. The divider wall configured to form a first sub-arc area, a second sub-arc area, and an arc plate area. The first sub-arc area and the second sub-arc area are configured to be in flow communication with the arc plate area. The power distribution system further comprises a support coupled to the first wall and the side walls, and an arc plate coupled to the support. The arc plate having a body extending between the side walls and over the divider wall. The power distribution system also comprises a circuit breaker coupled to the housing and having a first sub-pole coupled within the first sub-arc area and a second sub-pole coupled within the second sub-arc area.

In a further aspect, a method of manufacturing an arc chute assembly is provided. The method comprises forming a housing having a first wall, a second wall, and a pair of side walls coupled to the first wall. The walls are configured to form an arc area. The method also comprises positioning a divider wall between the side walls. The divider wall configured to form a first sub-arc area, a second sub-arc area, and an arc plate area within the housing. The method further comprises coupling an arc plate to the housing. The arc plate having a body extending between the side walls and over the divider wall.

DETAILED DESCRIPTION OF THE INVENTION

Figure 1:
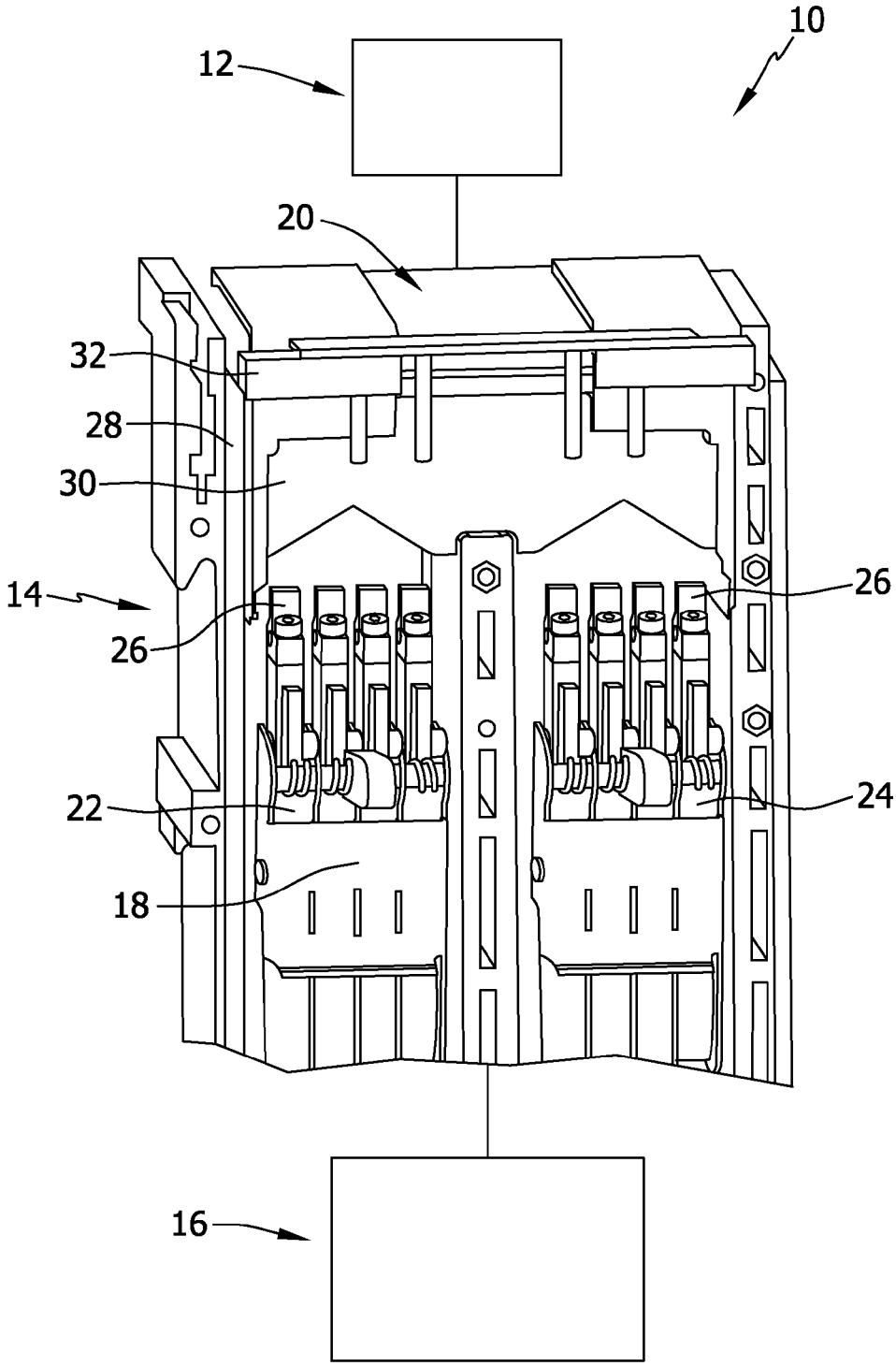
FIG. 1 illustrates a schematic block diagram of a circuit breaker.

FIG. 1 illustrates a schematic block diagram of a power distribution system 10 that includes a power source 12, a circuit breaker 14, and a power load 16. Power source 12 includes a line, such as, but not limited to, an incoming power line. Power load 16 includes an output, such as, but not limited to, an electrical device or a circuit. Circuit breaker 14 includes a contact assembly 18 and an arc chute assembly 20. In one embodiment, circuit breaker 14 includes a first sub-pole 22 and a second sub-pole 24. Each sub-pole 22 and 24 has movable contacts 26. Arc chute assembly 20 includes a housing 28, an arc plate 30, and a support 32. Arc chute assembly 20 is configured to facilitate distributing gas pressure formed when breaker contacts 26 open under an over-current load condition. Arc chute assembly 20 is also configured to facilitate quenching an electric arc formed when breaker contacts 26 open during the over-current load condition.

Figure 2:
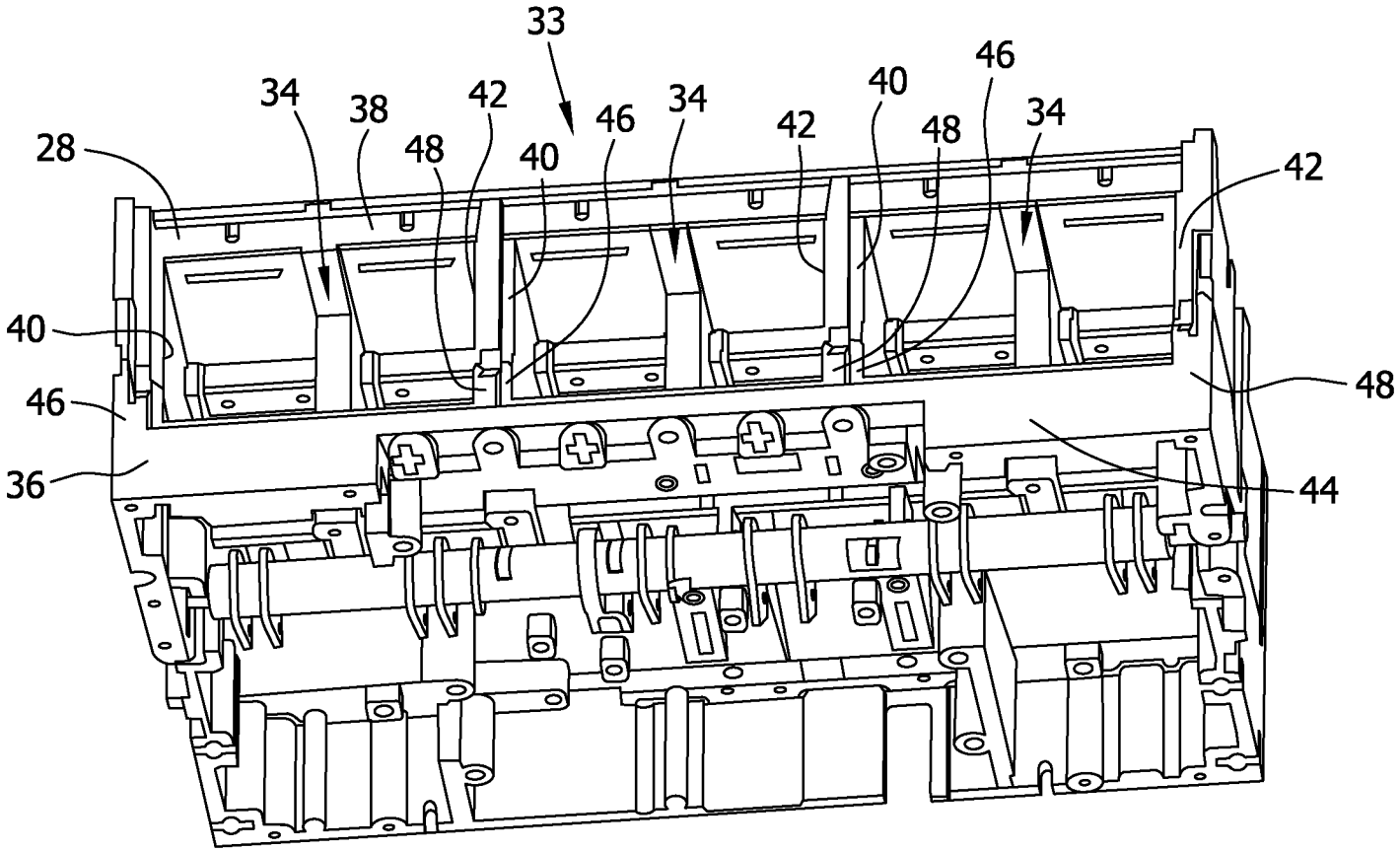
FIG. 2 illustrates a top perspective view of a housing assembly used with the circuit breaker shown in FIG. 1.

FIG. 2 illustrates a top perspective view of a housing assembly 33 used with the circuit breaker shown in FIG. 1. Housing assembly 33 includes three arc chambers, or arc areas, 34 formed by first housing 28 and a second housing 36. First housing 28 includes a first wall 38 and a pair of side walls 40, 42 coupled thereto and extending therefrom. Second housing 36 includes a second wall 44 and a pair of side walls 46, 48 extending therefrom. First housing 28 is connected to second housing 36 such that first housing side walls 40, 42 contact second housing side walls 46, 48, respectively.

Figure 3:
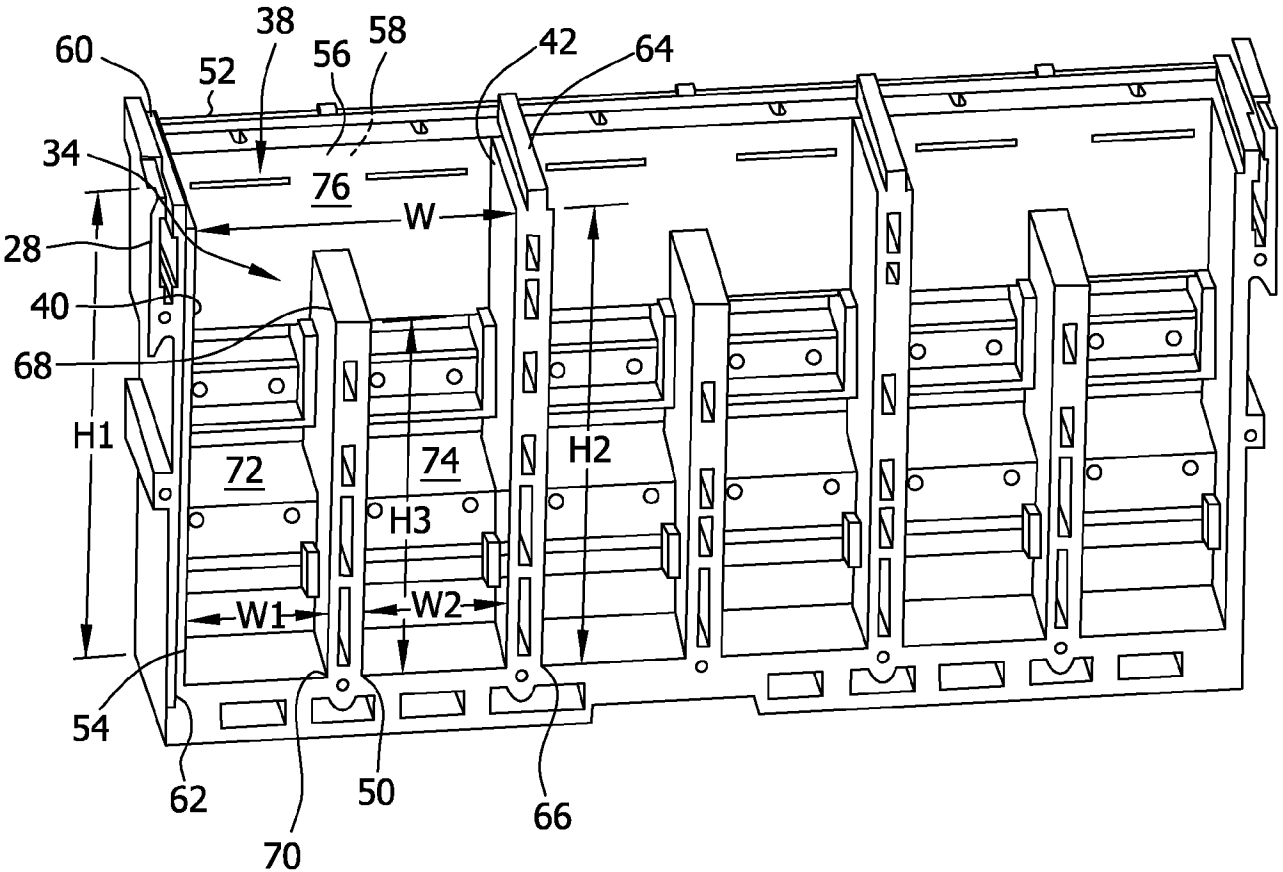
FIG. 3 illustrates a front perspective view of a portion of the housing used with the circuit breaker shown in FIG. 1.

FIG. 3 illustrates a front prospective view of first housing 28 used with power distribution system 10 (shown in FIG. 1). First housing 28 is configured to withstand gas pressures generated when circuit breaker contacts 26 (shown in FIG. 1) open during an over-current load condition. First housing 28 includes a divider wall 50. First wall 38 includes a top 52, a bottom 54, an inner side 56, and an outer side 58. Side wall 40 couples to inner side 56 and extends outward from inner side 56. Side wall 40 includes a top 60, a bottom 62, and a height H1 extending between top 60 and bottom 62. Side wall 42 couples to inner side 56 and extends outward from inner side 56. Side wall 42 includes a top 64, a bottom 66, and a height H2 extending between top 64 and bottom 66. Divider wall 50 couples to inner side 56 and extends outward from inner side 56. Divider wall 50 includes a top 68, a bottom 70, and a height H3 extending between top 68 and bottom 70. In one embodiment, height H3 of divider wall 50 is less than at least one of height H1 and height H2.

First wall 38 and side walls 40, 42 form at least a portion of arc area 34. Arc area 34 has a width W extending from side wall 40 to side wall 42. Divider wall 50 is positioned between side walls 40, 42 such that divider wall 50 and side wall 40 form a first sub-arc area 72 and divider wall 50 and side wall 42 form a second sub-arc area 74. In addition, an arc plate area 76 is positioned over divider wall 50. First sub-arc area 72 and second sub-arc area 74 open into arc plate area 76 and are in flow communication with arc plate area 76. First sub-arc area 72 has a width W1. In one embodiment, width W1 is less than width W of arc area 34. Second sub-arc area 74 has a width W2. In an embodiment, width W2 is less than width W of arc area 34. In the exemplary embodiment, width W1 is substantially the same as width W2.

Figure 4:
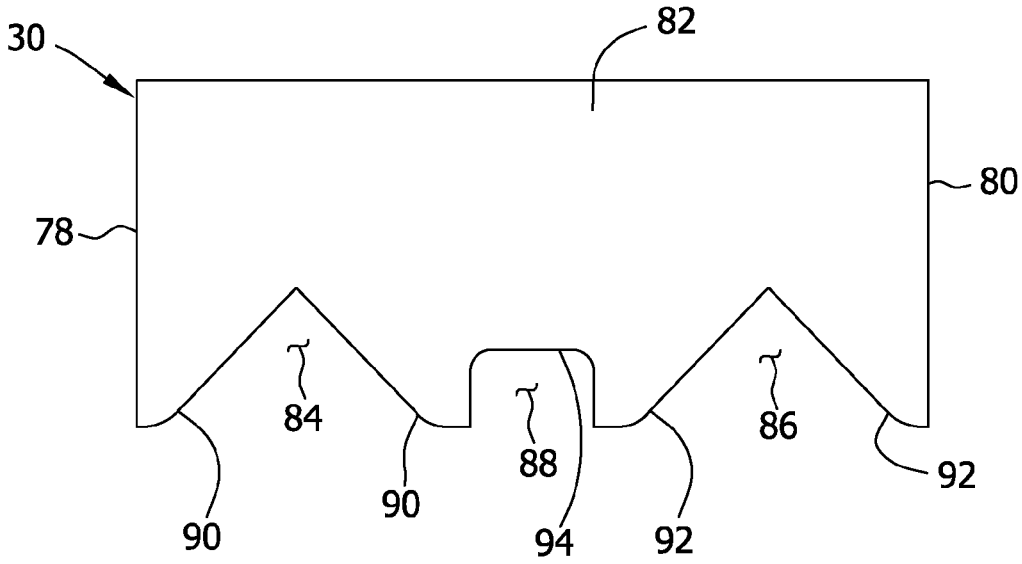
FIG. 4 illustrates a front view of an exemplary arc plate.

FIG. 4 illustrates a front view of arc plate 30. Arc plate 30 couples to support 32 (shown in FIG. 1) to facilitate quenching arc energy. Arc plate 30 includes a first end 78, a second end 80, and a body 82 extending between first end 78 and second end 80. In one embodiment, body 82 is formed from an electrically conductive and/or magnetic material such as, for example, steel to facilitate attracting arc energy.

Arc plate 30 includes a first recess 84, a second recess 86, and a third recess 88 such that first recess 84, second recess 86, and third recess 88 extend into body 82. First recess 84 and second recess 86 are configured to permit movement of contacts 26 (shown in FIG. 1). Third recess 88 is configured to facilitate positioning arc plate 30 within housing 28 (shown in FIG. 3). In one embodiment, third recess 88 is positioned between first recess 84 and second recess 86.

First recess 84 is defined by edges 90 and second recess 86 is defined by edges 92. In one embodiment, edges 90 are angled toward each other and edges 92 are angled toward each other. In the exemplary embodiment, first recess 84 and second recess 86 are substantially "V"-shaped. In alternative embodiments, first recess 84 and second recess 86 include other shapes, such as, but not limited to, rounded shapes to permit movement of contacts 26.

Third recess 88 is defined by an edge 94. In the exemplary embodiment, third recess 88 is substantially "U"-shaped and is configured to permit positioning of arc plate 30 over divider wall 50 such that divider wall 50 extends at least partially within third recess 88. Third recess 88 can include other shapes such as, but not limited to, angled shapes that permit positioning arc plate 30 within housing 28. In one embodiment, third recess 88 is complimentary to a shape of top 68 of divider wall 50.

Figure 5:
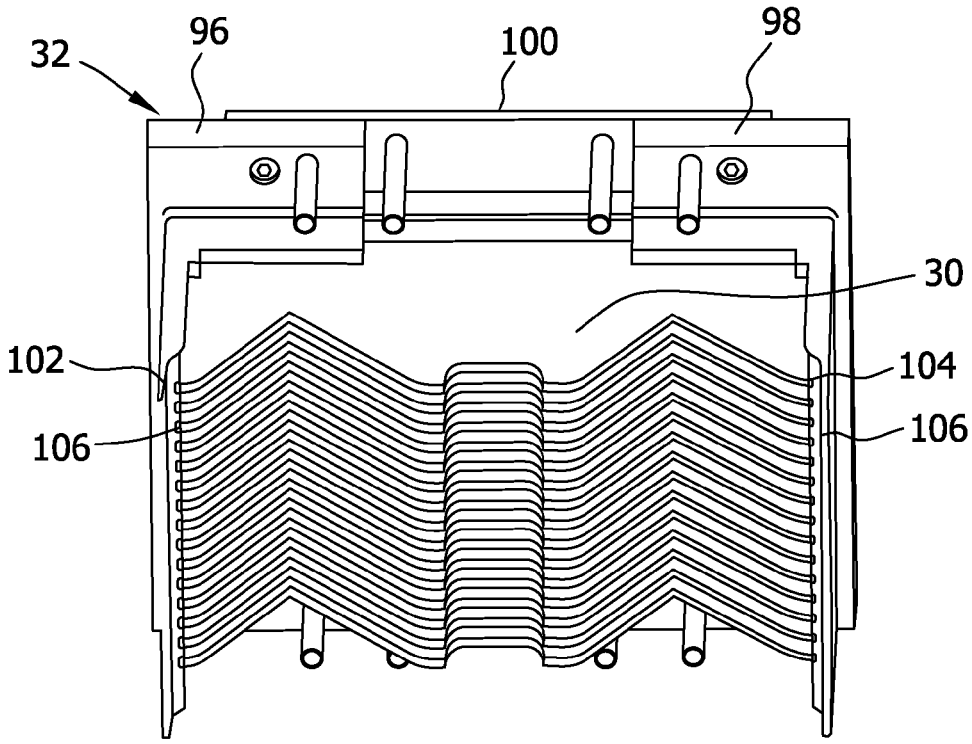
FIG. 5 illustrates a front perspective view of a support coupled to the arc plate shown in FIG. 4.

FIG. 5 illustrates a first perspective view of support 32 coupled to a plurality of arc plates 30. In one embodiment, support 32 is coated with gas evolving materials such as, but not limited to, cellulous filled melamine formaldehyde, glass polyester filled with alumina trihydrate (ATH) or by providing inserts made of such materials to facilitate distributing an increased volume of gas generated during current interruption.

Support 32 is configured to facilitate coupling arc plates 30 to first housing 28 (shown in FIG. 3). Support 32 includes a first top section 96, a second top section 98, and a vent section 100 coupled to first top section 96 and second top section 98. First top section 96 includes a first side wall 102 configured to hold at least one arc plate 30. Second top section 98 includes a second side wall 104 configured to hold at least one arc plate 30. In one embodiment, each side wall 102 and 104 includes a fastener 106 configured to couple to arc plate 30. Fastener 106 is sized and shaped such that arc plate 30 can be removably coupled thereto.

Figure 6:
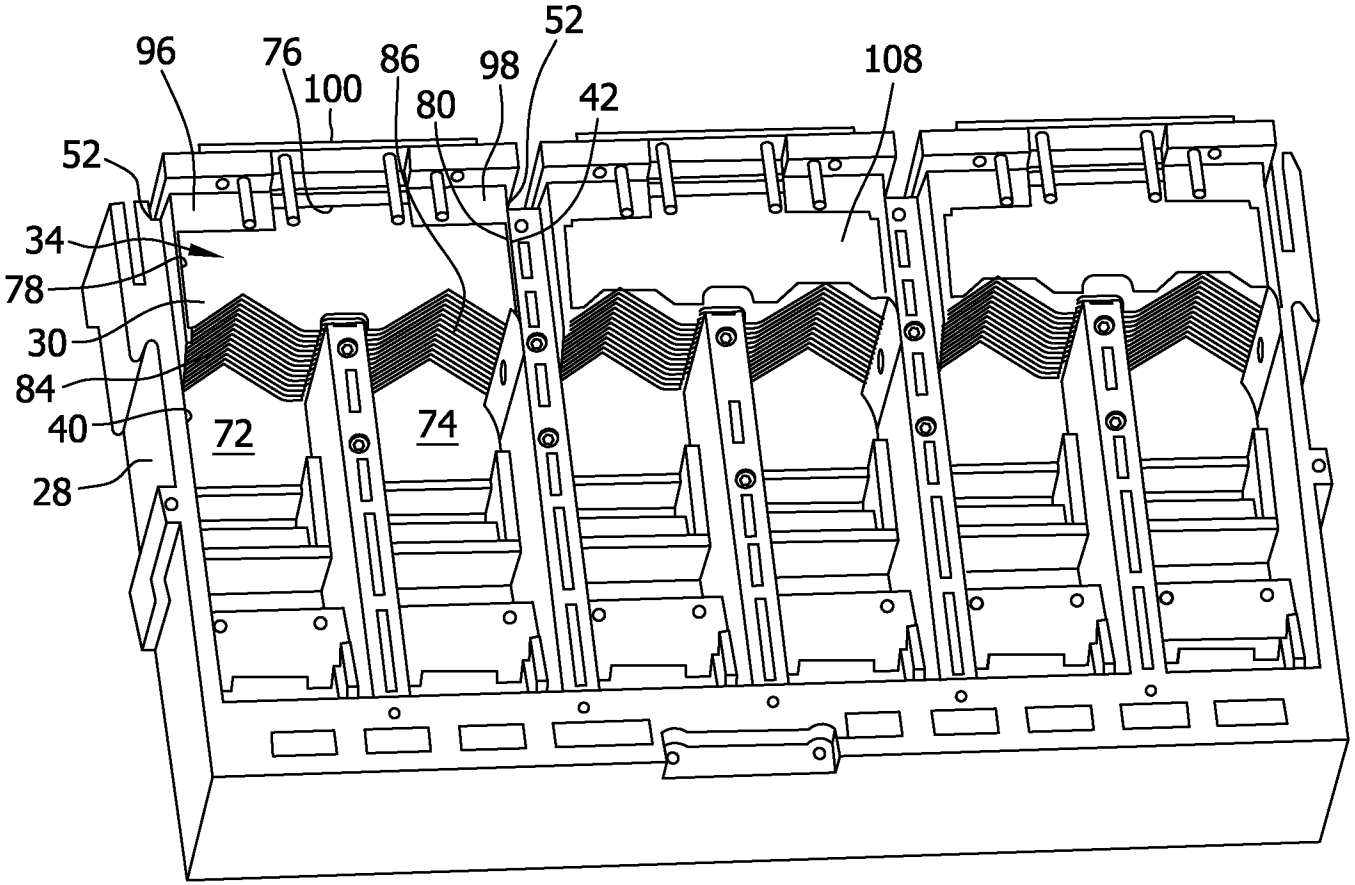
FIG. 6 is a front perspective view of the support and arc plate coupled to the housing shown in FIG. 3.

FIG. 6 is a front perspective view of a plurality of arc plates 30 and support 32 coupled to first housing 28. For illustrative purposes, FIG. 6 illustrates three arc chute assemblies 20. In alternative embodiments, any number of arc chute assemblies 20 can be used to facilitate operation of circuit breaker 14 (shown in FIG. 1). In one embodiment, first top section 96 is coupled to first wall top 52 and to side wall top 60 and second top section 98 is coupled to first wall top 52 and to side wall top 64. In the exemplary embodiment, vent section 100 is positioned between first top section 96 and second top section 98.

In one embodiment, each arc plate 30 is coupled to support 32 and is positioned within arc area 34. In the exemplary embodiment, each arc plate first end 78 is coupled to first top section 96 in a position adjacent housing side wall 40. In addition, each arc plate second end 80 is coupled to second top section 98 in a position adjacent housing side wall 42. Each arc plate 30 extends within and across arc plate area 76 in a position over first sub-arc area 72 and second sub-arc area 74. First recess 84 is positioned over first sub-arc area 72 and second recess 86 is positioned over second sub-arc area 74. Further, as illustrated, each third recess 88 is positioned over divider wall 50.

Arc plates 30 are positioned and interconnected parallel to one another within support 32. Arc plates 30 are laterally offset relative to one another in the same direction so that cavities formed by individual recesses 84 and 86 follow the radii of each moveable contact 26. As further illustrated in FIG. 6, arc chute assembly 20 further includes at least one cover plate 108 coupled to support 32. Cover plate 108 is configured to facilitate aligning arc plates 30 within support 32. For illustrative purposes, two exemplary arc chute assemblies 20 are shown that include cover plate 108 and one exemplary arc chute assembly 20 is shown with cover plate 108 removed.

Figure 7:
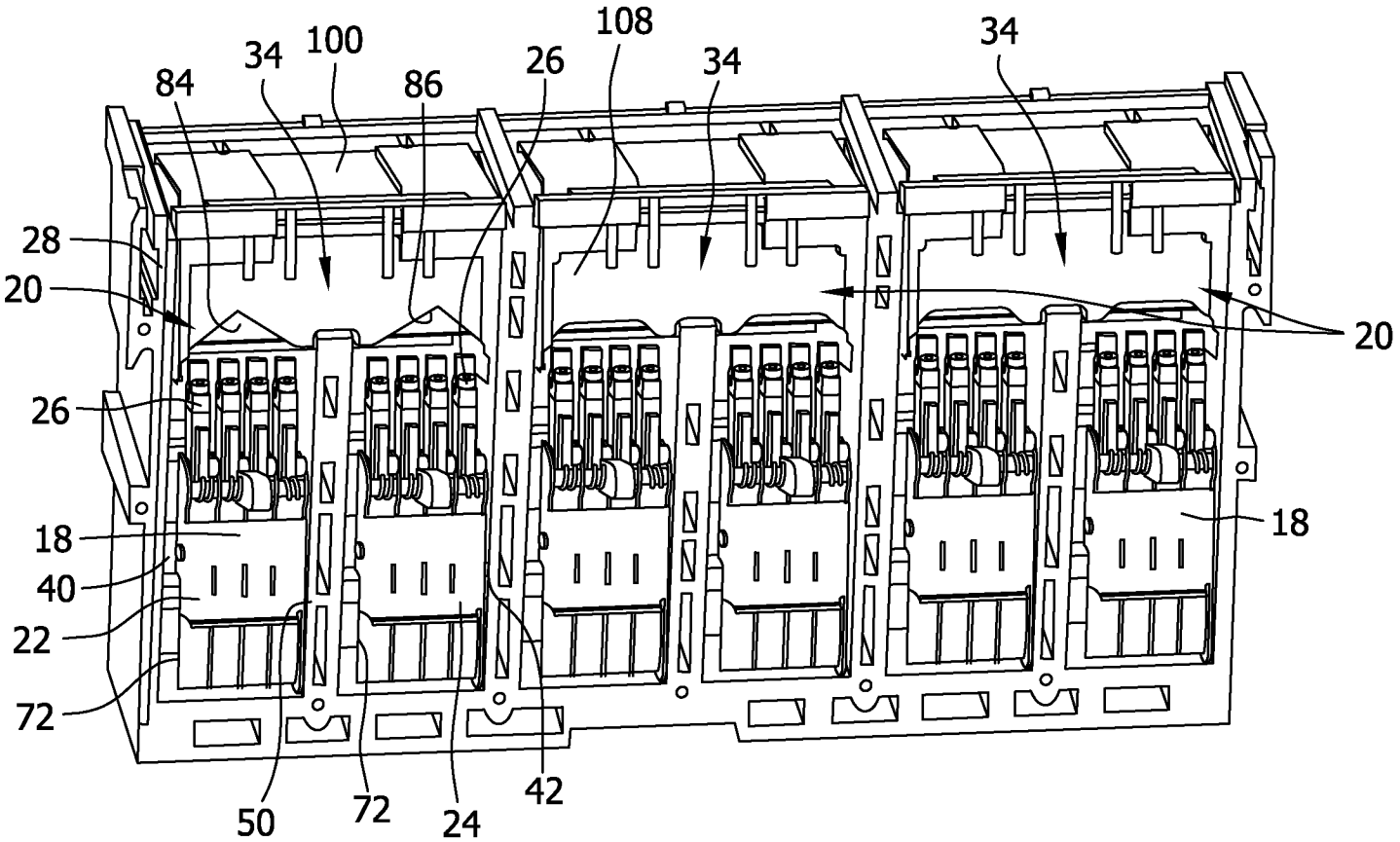
FIG. 7 illustrates a front perspective view of a plurality of circuit breakers and arc chute assemblies.

FIG. 7 illustrates a front perspective view of three arc chute assemblies 20 and contact assemblies 18. In alternative embodiments, more or less than three arc chute assemblies 20 are used to facilitate operation of circuit breaker 14 (shown in FIG. 1). Each arc chute assembly is associated with one phase of a 3-phase power distribution system. More specifically, first sub-pole 22 and second sub-pole 24 are associated with a single phase of power received from power source 12 (shown in FIG. 1). First sub-pole 22 and second sub-pole 24 are coupled to housing 28. In the exemplary embodiment, first sub-pole 22 is coupled within first sub-arc area 72 adjacent side wall 40 and second sub-pole 24 is coupled within second sub-arc area 74 adjacent side wall 42. First sub-pole 22 and second sub-pole 24 are arranged on opposite sides of divider wall 50 within respective sub-pole arc areas 72 and 74. Side walls 40, 42 and divider wall 50 mechanically associate sub-poles 22 and 24 with each other for structural support to facilitate sub-poles 22 and 24 withstanding stresses when circuit breaker operates or "trips" to open contacts 26 during an over-current load condition. Contacts 26 of first sub-pole 22 are positioned partially within first recess 84 and contacts 26 of second sub-pole 24 are positioned within second recess 86. Cavities formed by respective individual recesses 84 and 86 follow the radii of each moveable contact 26 during the over-current load condition.

During an exemplary mode of operation, current flows from power source 12 (shown in FIG. 1) through circuit breaker 14 to power load 16 (shown in FIG. 1). When an over-current load condition occurs, circuit breaker 14 trips to facilitate current interruption between power source 12 and power load 16. The tripping of circuit breaker 14 causes contacts 26 of first sub-pole 22 to rapidly open and pivot through cavities formed by first recess 84 of arc plates 30 and causes contacts 26 of second sub-pole 24 to rapidly open and pivot through cavities formed by second recess 86 of arc plates 30. When contacts 26 open, an electric arc may be generated which can allow current to continue to flow through gases formed by the arc. The gas formation by the arc increases pressure within arc chute assembly 20.

Divider wall 50 is shorter than side wall 40 and side wall 42 such that arc plate area 76 extends between side wall 40 and side wall 42 and over first sub-arc area 72 and second sub-arc area 74 to provide an increased volume within arc chute assembly 20 compared to conventional arc chutes. The height of divider wall 50 permits flow communication between first sub-arc area 72, second sub-arc area 74 and arc plate area 76 to allow pressure equalization between first sub-arc area 72 and second sub-arc area 74. Arc chute assembly 20 is thus configured to distribute gas pressure formed as contacts 26 of contact assembly 18 open during over-current load conditions. Further, arc chute assembly 20 is configured to facilitate quenching arcs formed as contacts 26 of contact assembly 18 open during over-current load conditions. More particularly, arc chute assembly 20 directs the gas flow from one or both first sub-arc area 72 and second sub-arc area 74 to arc plate area 76 and arc plates 30 to enhance arc cooling and more rapid termination of the arc, while simultaneously, distributing the increased gas pressure created by the arc. Irrespective of which sub-pole 22 and 24 experiences higher arc energy, the gas pressure applied against housings 28, 36 is dispersed and reduced due to the flow communication between first sub-arc area 72 and arc plate area 76 and between second sub-arc area 74 and arc plate area 76.

Additionally, since divider wall 50 is shorter than side wall 40 and side wall 42, each arc plate 30 extends between side walls 40 and 42 within arc plate area 76 and above sub-arc areas 72 and 74. Arc plates 30 provide more surface area compared to conventional arc plates that extend only above one sub-arc area since arc plates 30 extend from side wall 40 to side wall 42 and above both sub-arc areas 72 and 74. The inclusion of a plurality of arc plates 30 facilitates splitting the arcs into a series of smaller arcs to quickly dissipate and extinguish the arcs. Further, cooling effects result from arc attachment to arc plates 30, vaporization of arc plates 30, and discharge of gas out of vent section 100.

Figure 8:
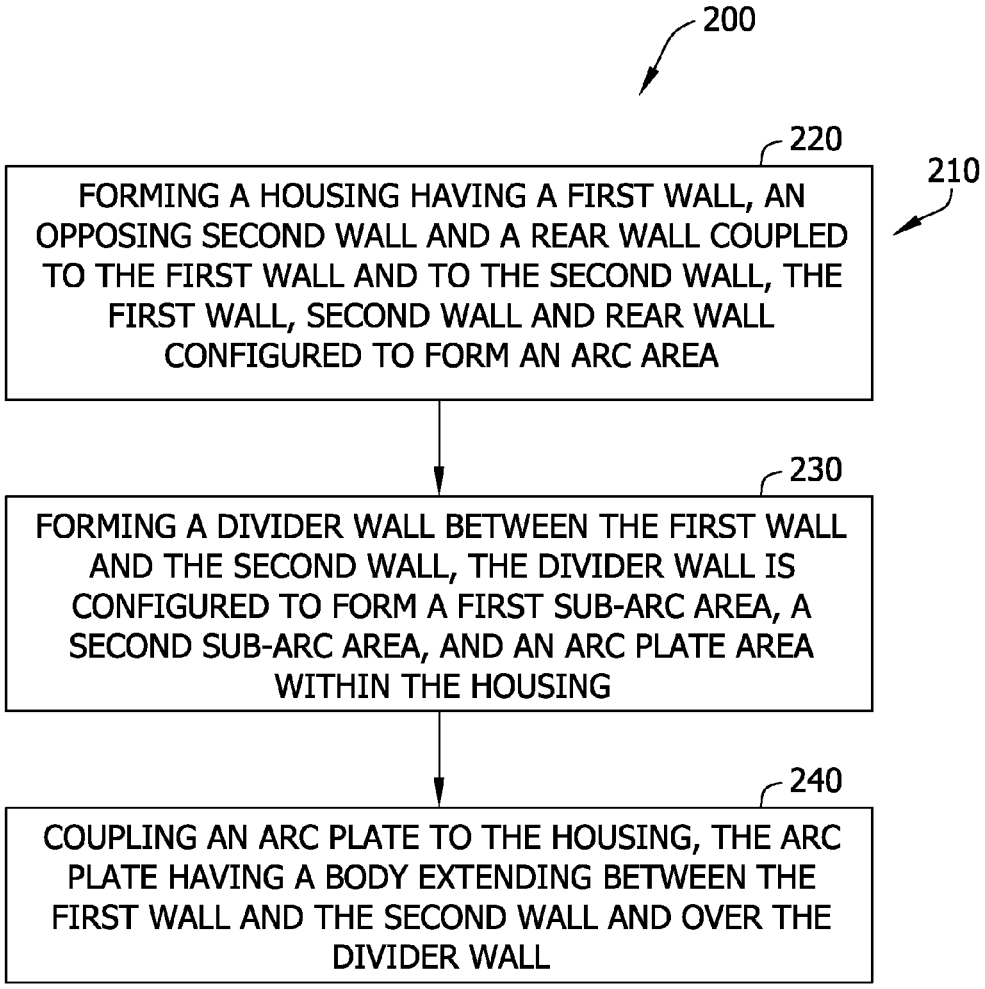
FIG. 8 is an exemplary flowchart illustrating a method of manufacturing an arc chute assembly.

FIG. 8 is an exemplary flowchart 200 illustrating a method 210 of manufacturing an arc chute assembly, for example arc chute assembly 20 (shown in FIG. 1). Method 210 includes forming 220 a pair of housings, such as housings 28, 36 (shown in FIG. 2). The first housing has a first wall coupled to a pair of side walls and the second housing has a second wall coupled to a pair of side walls. The first and second walls and the respective side walls form an arc area. Method 210 further includes positioning 230 a divider wall, for example divider wall 50 (shown in FIG. 3), between the side walls to form a first sub-arc area, a second sub-arc area, and an arc plate area within the housing. The divider wall has a height that is less than a height of at least one of the side walls and the first sub-arc area and the second sub-arc area are in flow communication with the arc plate area.

Additionally, a plurality of arc plates, such as arc plates 30 (shown in FIG. 4), are coupled 240 to the housing and extend between the first wall and the second wall and over the divider wall. The method includes forming a first recess, a second recess, and a third recess within the arc plate. The method also includes positioning the first recess of the arc plate over the first sub-arc area and positioning the second recess of the arc plate over the second sub-arc area such that the first recess and the second recess provide passageways for movement of contacts of a circuit breaker.

The embodiments described herein provide an arc chute assembly for a circuit breaker. The sizing, shapes and orientations of the arc chute assembly facilitate current interruption by quenching arcs generated during a circuit breaker fault condition. The arc chute assembly can be used for new manufacture of power modules or to retro fit existing circuit breakers. In one embodiment, the divider wall is shorter than the side walls and forms a high volume arc plate area for gas dispersion. In the exemplary embodiment, a plurality of arc plates extends across the arc plate area and above the sub-arc areas to provide more surface area for arc attachment.

A technical effect of the arc chute assembly described herein is that the arc plate area provides more volume for gas expansion and dispersion. A further technical effect of the arc chute assembly is that the first sub-arc area and the second sub arc area are in flow communication with the arc plate area to allow pressure equalization between the first sub-arc area and the second sub-arc area. Another technical effect of the arc chute assembly is that the arc plates extend across the arc plate area to provide more surface area for arc attachment.

Exemplary embodiments of the arc chute assembly and methods of manufacturing are described above in detail. The arc chute assembly and methods are not limited to the specific embodiments described herein, but rather, components of the arc chute assembly and/or steps of the method may be utilized independently and separately from other components and/or steps described herein. For example, the arc chute assembly and methods may also be used in combination with other electrical systems and methods, and are not limited to practice with only the power module as described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any layers or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An arc chute assembly comprising:

a housing having a first wall, a second wall, and a pair of side walls coupled to said first wall, said walls configured to form an arc area, the housing further having a divider wall coupled to said first wall between said side walls, said divider wall configured to form a first sub-arc area, a second sub-arc area, and an arc plate area, said first sub-arc area and said second sub-arc area configured to be in flow communication with said arc plate area;

a support coupled to said first wall and said side walls; and at least one arc plate coupled to said support, said arc plate having a body extending between said side walls and over said divider wall, said at least one arc plate comprising a notch configured to receive at least a portion of said divider wall.

2. The arc chute assembly of claim 1, wherein said at least one arc plate is positioned over said first sub-arc area and said second sub-arc area.

3. The arc chute assembly of claim 1, wherein said at least one arc plate includes a first recess positioned over said first sub-arc area.

4. The arc chute assembly of claim 1, wherein said at least one arc plate includes a second recess positioned over said second sub-arc area.

5. The arc chute assembly of claim 1, wherein said divider wall has a height less than a height of at least one of said side walls.

6. The arc chute assembly of claim 1, wherein said arc plate area has a width that extends between said side walls.

7. The arc chute assembly of claim 6, wherein said first sub-arc area and said second sub-arc each have a width less than the width of said arc plate area.

8. The arc chute assembly of claim 1, wherein said first sub-arc area and said second sub-arc area are substantially the same size.

9. The arc chute assembly of claim 1, wherein said notch comprises a substantially rectangular profile.

10. The arc chute assembly of claim 1, wherein said at least one arc plate comprises a plurality of substantially similar arc plates.

11. A power distribution system comprising:

a housing having a first wall, a second wall and a pair of side walls coupled to said first wall, said first wall and said side walls configured to form an arc area, the housing further having a divider wall coupled to said first wall between said side walls, said divider wall configured to form a first sub-arc area, a second sub-arc area, and an arc plate area, said first sub-arc area and said second sub-arc area configured to be in flow communication with said arc plate area;

a support coupled to said first wall and said side walls;

at least one arc plate coupled to said support, said arc plate having a body extending between said side walls and over said divider wall, said at least one arc plate comprising a notch configured to receive at least a portion of said divider wall; and a circuit breaker coupled to said housing and having a first sub-pole coupled within said first sub-arc area and a second sub-pole coupled within said second sub-arc area.

12. The power distribution system of claim 11, wherein said at least one arc plate includes a first end coupled to said support adjacent one said side wall and a second end coupled to said support adjacent another said side wall.

13. The power distribution system of claim 11, wherein said at least one arc plate is positioned over said first sub-arc area and said second sub-arc area.

14. The power distribution system of claim 11, wherein said at least one arc plate includes a first recess positioned over said first sub-arc area and a second recess positioned over said second sub-arc area.

15. The power distribution system of claim 14, wherein said notch is between said first recess and said second recess.

16. The arc chute assembly of claim 11, wherein said divider wall has a height less than a height of at least one of said side walls.

17. The power distribution system of claim 11, wherein said arc plate area is configured to distribute gas pressure formed in said first sub-arc area and said second sub-arc area.

18. A method of manufacturing an arc chute assembly, the method comprising:

forming a housing having a first wall, a second wall, and a pair of side walls coupled to the first wall, said walls configured to form an arc area;

positioning a divider wall between the side walls, the divider wall configured to form a first sub-arc area, a second sub-arc area, and an arc plate area within the housing;

forming a notch in at least one arc plate; and coupling the at least one arc plate to the housing such that the notch receives at least a portion of the divider wall, the at least one arc plate having a body extending between the side walls and over the divider wall.

19. The method of claim 18, wherein forming the divider wall comprises forming the first sub-arc area and the second sub-arc area in flow communication with the arc plate area.

20. The method of claim 18, wherein coupling the at least one arc plate to the housing comprises positioning a first recess of the at least one arc plate over the first sub-arc area and positioning a second recess of the at least one arc plate over the second sub-arc area.

* * * * *